US006910973B2

(12) United States Patent
Kuster

(10) Patent No.: US 6,910,973 B2
(45) Date of Patent: Jun. 28, 2005

(54) GOLF SWING TRAINING DEVICE

(76) Inventor: Robert F. Kuster, 7013 W. Waterford Ave., Milwaukee, WI (US) 53220

( * ) Notice: Subject to any disclaimer, the term of this patent is extended or adjusted under 35 U.S.C. 154(b) by 9 days.

(21) Appl. No.: 10/717,841

(22) Filed: Nov. 20, 2003

(65) Prior Publication Data

US 2005/0113181 A1 May 26, 2005

(51) Int. Cl.[7] ..... A63B 69/36; A63B 21/04
(52) U.S. Cl. ..... 473/219; 473/258
(58) Field of Search ..... 473/219, 223, 473/226, 229, 258; 273/DIG. 21; 482/92, 482/129, 123, 139, 904, 82

(56) References Cited

U.S. PATENT DOCUMENTS 2,848,234 A * 8/1958 Brandon ..... 473/229
3,102,316 A * 9/1963 Cadley ..... 24/650
3,462,156 A * 8/1969 Gentry ..... 473/229
4,093,211 A * 6/1978 Hughes et al. ..... 482/49
4,186,921 A * 2/1980 Fox ..... 29/461
4,664,388 A * 5/1987 Huber ..... 473/138
4,733,861 A * 3/1988 Plunkett, III ..... 482/126
5,007,635 A * 4/1991 Tiller ..... 482/129
5,040,788 A * 8/1991 Randall ..... 482/129
5,190,508 A * 3/1993 Kliewer et al. ..... 482/82
5,211,612 A * 5/1993 Carbonero ..... 482/81
5,615,879 A * 4/1997 Bailey ..... 473/424
5,947,835 A * 9/1999 Fenton, Jr. ..... 473/229

* cited by examiner

*Primary Examiner*—Gregory Vidovich
*Assistant Examiner*—Nini F. Legesse

(57) ABSTRACT

A golf swing training device includes a grip including a grip bore, a shaft including a shaft bore, a tension cord received within the grip bore and the shaft bore, a first securing device configured to prevent the tension cord from slipping out of the grip bore and the shaft bore, and a second securing device configured to prevent the tension cord from slipping out of the grip bore and the shaft bore, wherein the second securing device creates tension on the tension cord by restricting movement of the training device and is configured to be received within an opening formed in an open door.

8 Claims, 5 Drawing Sheets

GOLF SWING TRAINING DEVICE

BACKGROUND OF THE INVENTION

1. Field of the Invention

The invention relates to the sport of golf, and includes a device to improve the golf swing of the player that assists the user in developing a correct backswing, downswing and follow through. In particular, the present invention relates to a portable golf swing training device with an anchor assembly that allows a golfer to use a door to practice his/her swing. A hook also allows the device to be anchored to a free standing pole.

2. Discussion of the Related Art

The very popular sport of golf entails a very complex motion to swing a golf club so as to either propel a golf ball a maximum distance in a desired direction, or to propel the golf ball a carefully controlled distance in a precisely determined direction. Almost all golf players strive to improve their skill at the game, and improved skill generally leads to increased enjoyment of the game.

Despite the complexity of the golf swing, the usual game of golf typically entails a relatively small number of swings or strokes, generally in the range of 70 to 100 or so, and about a third of these are putting strokes that require an entirely different technique. Because of variations in topography on a golf course, few of the remaining swings are the truly repetitive swings needed for skill improvement. Thus even the most dedicated of golf players must usually resort to off-course practice to improve their golf skills.

Many golf players make use of golf driving ranges, which allow the player to practice repetitive swings under virtually identical conditions. While such practice is undoubtedly valuable, it requires a trip, sometimes of some considerable distance, to a golf driving range. Furthermore, simple repetition, as at a driving range, does not assure that the swing is being performed correctly. As a result, many golf training devices have been developed for use in the home (or the garage or backyard) to assist a golf player to improve his/her golf skill.

These devices, unfortunately, are often quite complex, require assembly and are not easily transported (e.g., on a business trip).

To be useful for the greatest possible number of golf players, a golf training device should also be inexpensive, should not occupy much space in the home when not in use, and should be quickly and easily set up for use, and quickly and easily disassembled after use.

Perfecting the golf backswing—the initial part of the golf swing, in which the golfer swings the golf club to a position above and in front of the trailing shoulder (the right shoulder for a right handed golfer) to begin the swing—is an often-neglected activity in efforts to improve one's golf skill, yet many golf teachers consider the backswing to be the key to a good golf swing. A consistently good swing cannot be developed if the backswing is poor or inconsistent. Therefore, there is a need for an effective training device to assist golfers in perfecting their backswing.

Ideally, such a training device should also provide assistance in perfecting the downswing-the phase of the golf swing immediately following the backswing, where the golfer brings the golf club down from the position at the top or end of the backswing to the position of impact on the golf ball. Such a device could thus assist golf players both in the perfection of their backswing and the transition to the downswing.

Furthermore, golf players, in striving to improve their golf swing, must learn to use their non-dominant arm and shoulder muscles to produce the major force of the golf swing, particularly of the downswing, and to counteract the tendency to let the dominant side take over. That is, a right-hand-dominant golf player must train himself/herself to use the left arm and shoulder to produce most of the power of the golf swing. Proper use of the non-dominant arm and shoulder must be imprinted on the golf player, and an ideal golf swing training device should assist the user in strengthening the musculature of the non-dominant side, and make the use of the non-dominant side, to provide most of the golf swing's power, a reflexive action. The dominant-side musculature does, of course, provide important power to the golf swing, in the impact and post-impact phases of the swing.

Accordingly, there is a significant and important unmet need in the field of golf training for proper golf swing plane training, and more particularly for a device that is simple yet effective and addresses the issues of development of muscle memory in the upper body for proper lead-side dominance to produce a smooth, consistent and controllable swing plane.

SUMMARY OF THE INVENTION

According to one aspect of the invention, a golf swing training device includes a grip including a grip bore, a tension cord received within the grip bore, a first securing device configured to prevent the tension cord from slipping out of the grip bore, and a second securing device configured to prevent the tension cord from slipping out of the grip bore, wherein the second securing device creates tension on the tension cord by restricting movement of the training device.

According to another aspect of the invention, a golf swing training device includes a grip including a grip bore, a shaft including a shaft bore, a tension cord received within the grip bore and the shaft bore, a first securing device configured to prevent the tension cord from slipping out of the grip bore and the shaft bore, and a second securing device configured to prevent the tension cord from slipping out of the grip bore and the shaft bore, wherein the second securing device creates tension on the tension cord by restricting movement of the training device.

According to yet another aspect of the invention, a golf swing training device includes a grip including a grip bore, a shaft including a shaft bore, a tension cord received within the grip bore and the shaft bore, a first securing device configured to prevent the tension cord from slipping out of the grip bore and the shaft bore, and a second securing device configured to prevent the tension cord from slipping out of the grip bore and the shaft bore, wherein the second securing device creates tension on the tension cord by restricting movement of the training device and is configured to be received within an opening formed in an open door.

These and other objects, features, and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A clear understanding of the various advantages and features of the present invention, as well as the construction and operation of conventional components and mechanisms associated with the present invention, will become more readily apparent by referring to the exemplary, and therefore non-limiting, embodiments illustrated in the following drawings which accompany and form a part of this patent specification.

DETAILED DESCRIPTION OF THE PREFERRED EMBODIMENTS

Figure 1:
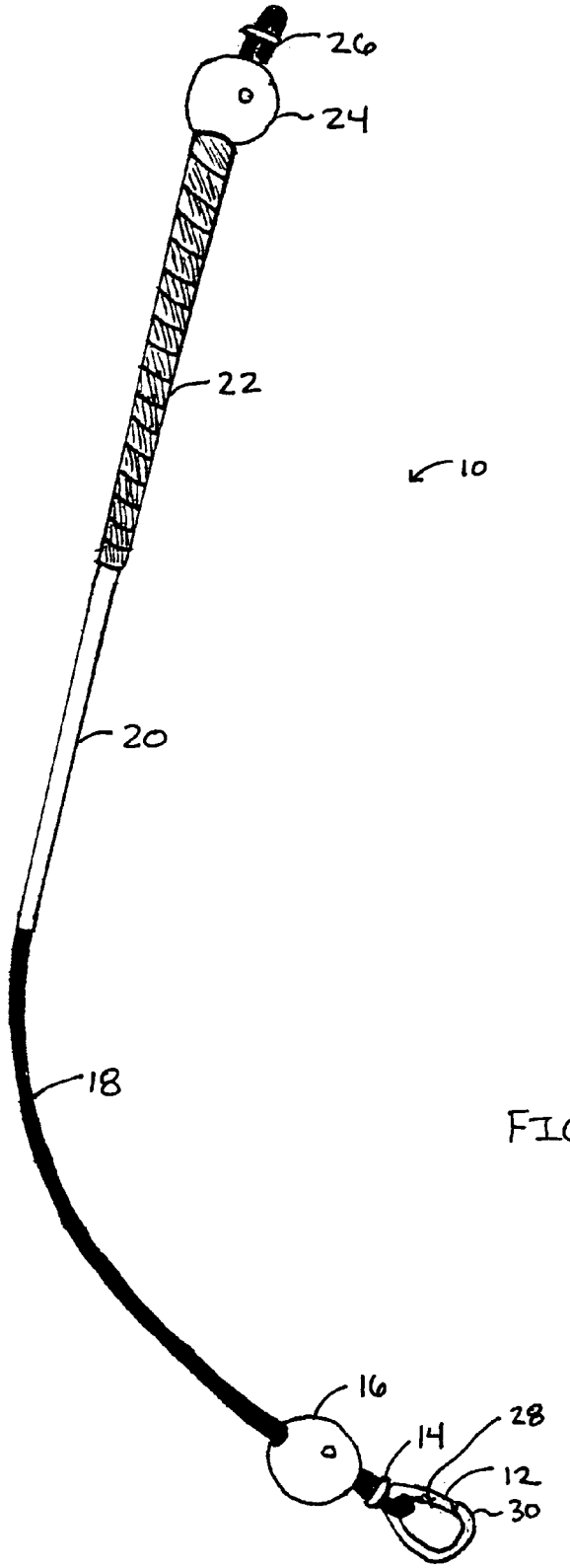
FIG. 1 is an illustration of the golf swing training device according to the preferred embodiment of the present invention.

As described above, there is a need in the field of golf training for proper golf swing plane training, and more particularly for a device that is simple yet effective and addresses the issues of development of muscle memory in the upper body for proper lead-side dominance to produce a smooth, consistent and controllable swing plane. In this regard, a golf swing training device 10 illustrated in FIG. 1 includes a D-ring clasp 12, a hog ring 14, a wood ball 16, a bungee cord 18, a golf shaft 20, a golf grip 22, a wood ball 24 and a hog ring 26.

D-ring clasp 12 is configured to attached device 10 to a wall or a free-standing pole by applying friction to a movable leg 28 of clasp 12 to open and close clasp 12. A hook portion 30 of clasp 12 is matingly secured to a ring or some other device (not shown). Training device 10 may also be secured to a wall or pole or some other non-moving surface using other attachment means (e.g., Velcro®, etc.).

Figure 2:
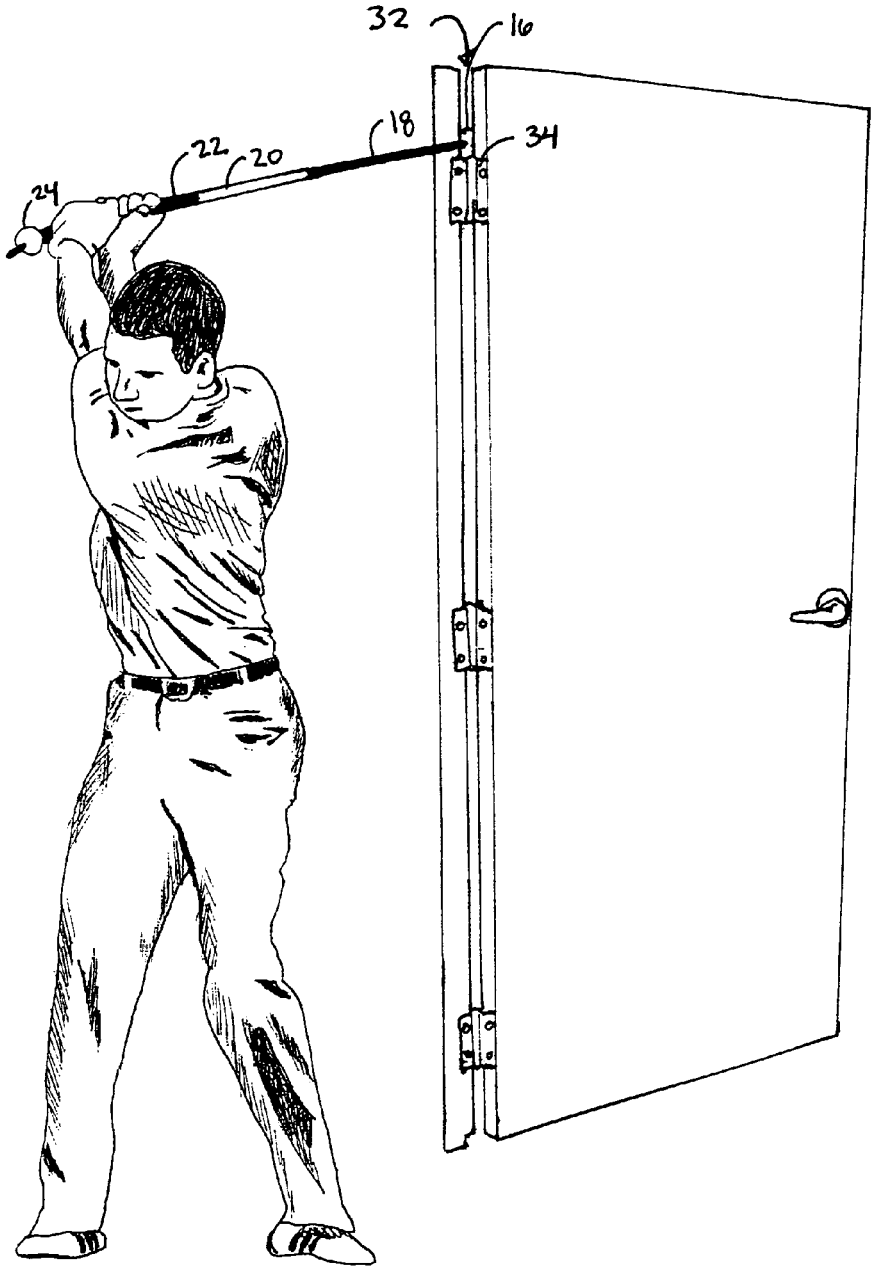
FIG. 2 is an illustration at the top of a backswing using the golf swing training device according to the preferred embodiment of the present invention.
Figure 3:
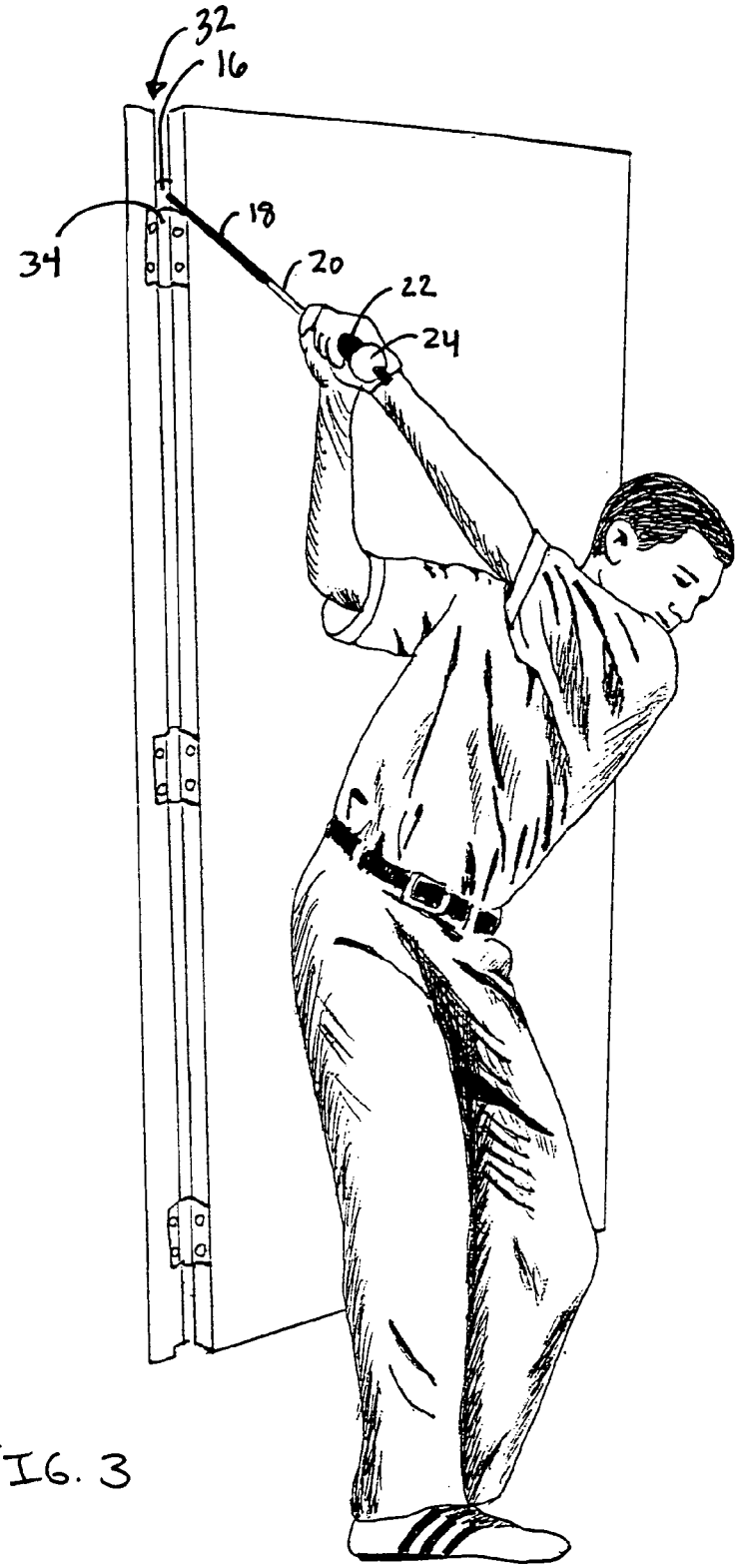
FIG. 3 is an illustration at the top of a backswing using the golf swing training device according to the preferred embodiment of the present invention.
Figure 4:
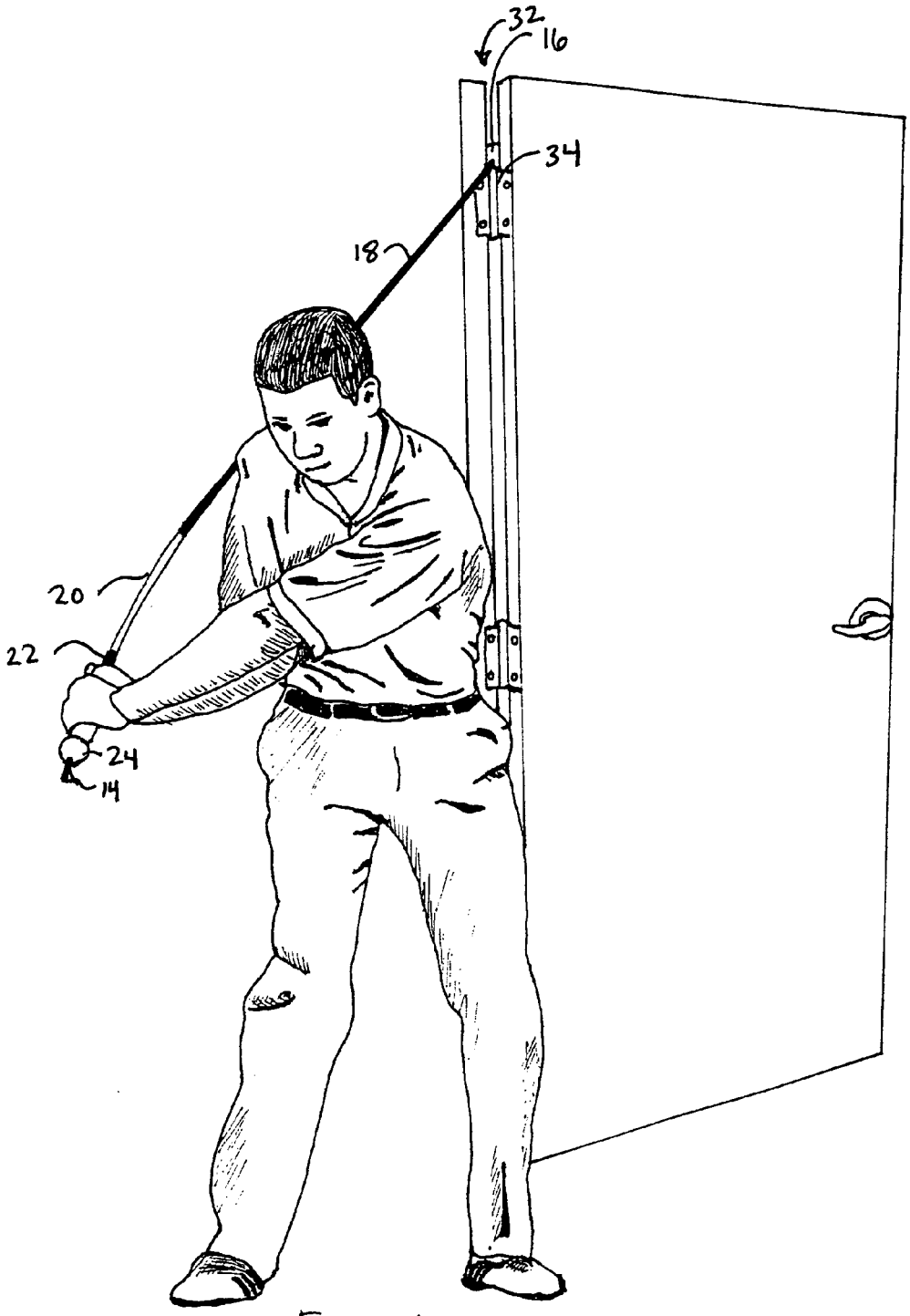
FIG. 4 is an illustration of a downswing using the golf swing training device according to the preferred embodiment of the present invention.
Figure 5:
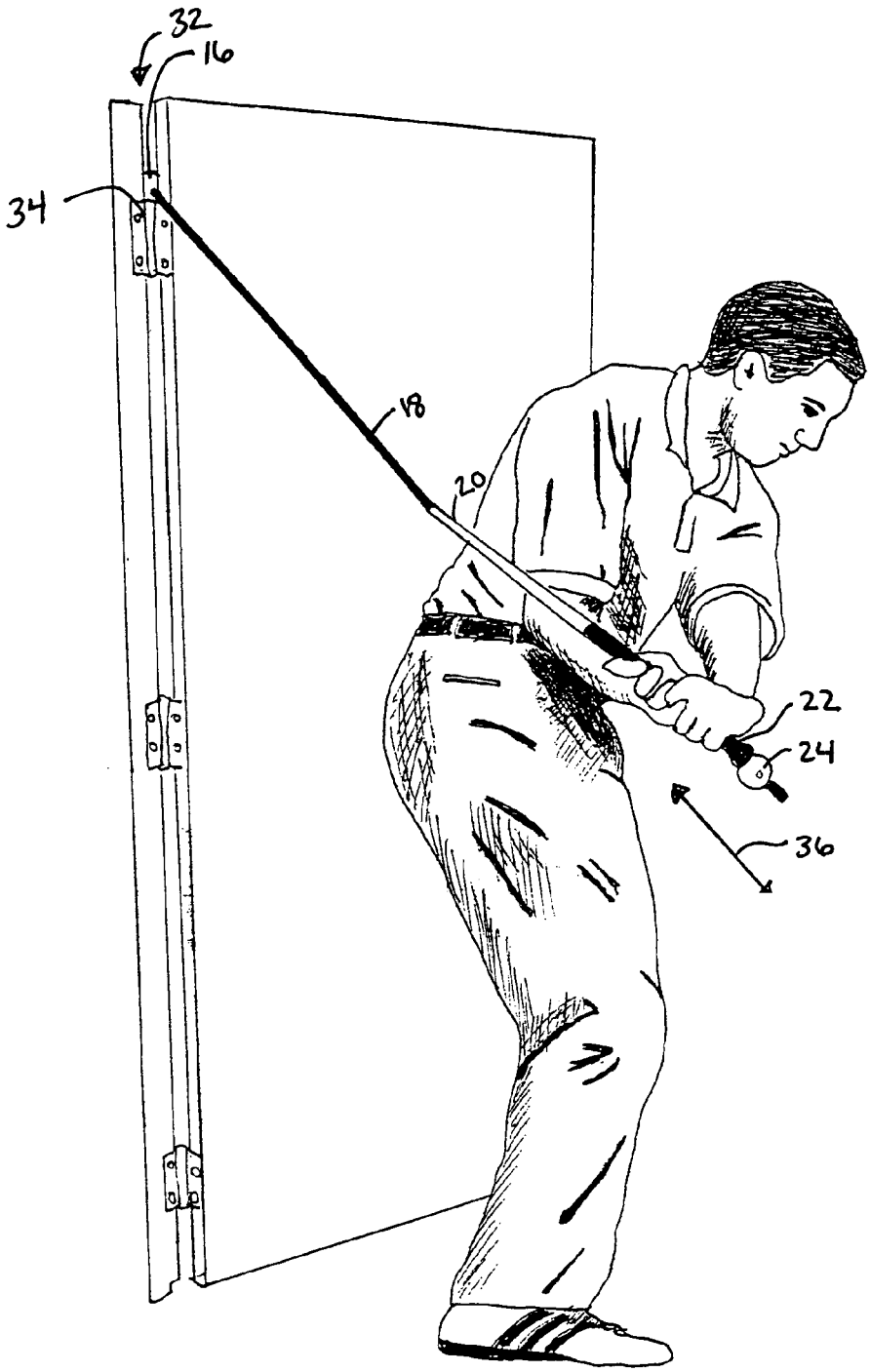
FIG. 5 is an illustration of a downswing using the golf swing training device according to the preferred embodiment of the present invention.

The operation of training device 10 is illustrated in FIGS. 2–5. In particular, wood ball 16 is configured to fit in a notch 32 of an open doorway. Ball 16 prevents device 10 from slipping through notch 32 and is restrained from vertical movement in a downward direction by a hinge 34. As illustrated in FIGS. 2–4, device 10 is at a preferred height for practicing the backswing that aids in muscle memory and decreases the tendency of the trainee from casting the club. In particular, device 10 stays loaded throughout the swing and restricts the common casting effect. The loading of device 10 (FIG. 4) assists the trainee in building muscles in the forearms, increases flexibility in the wrists, and keeps the device in an ideal swing plane 36 (FIG. 5).

The trainee may adapt bungee cord 18 to accommodate varying strengths by using bungee cords with different tensile ratings.

The scope of the application is not to be limited by the description of the preferred embodiments described above, but is to be limited solely by the scope of the claims that follow. For example, device 10 may be permanently secured to an object to prevent movement of device 10 without departing from the scope of the preferred embodiment of the present invention.

What is claimed is:

1. A golf swing training device comprising:
a grip including a grip bore;
a shaft including a shaft bore;
wherein said grip spans a substantial portion of the length of said shaft;
a tension cord received within the grip bore and the shaft bore;
a first securing device configured to prevent the tension cord from slipping out of the grip bore and the shaft bore;
a second securing device configured to prevent the tension cord from slipping out of the grip bore and the shaft bore, wherein the second securing device creates tension on the tension cord by restricting movement of the training device, and wherein the second securing device comprises a clasp.

2. The training device according to claim 1, wherein the clasp is attachable to a free-standing pole.

3. The training device according to claim 1, wherein the clasp is attachable to a wall.

4. A golf swing training device comprising:
a grip including a grip bore;
a shaft including a shaft bore;
wherein said grip spans a substantial portion of the length of said shaft;
a tension cord received within the grip bore and the shaft bore;
a first securing device configured to prevent the tension cord from slipping out of the grip bore and the shaft bore;
a second securing device configured to prevent the tension cord from slipping out of the grip bore and the shaft bore, wherein the second securing device creates tension on the tension cord by restricting movement of the training device, and wherein the second securing device comprises a ball that is larger in diameter than an opening that is created when a door is in an open position.

5. The training device according to claim 4, wherein the ball is manufactured from wood.

6. A golf swing training device comprising:
a grip including a grip bore;
a shaft including a shaft bore;
wherein said grip spans a substantial portion of the length of said shaft;
a tension cord received within the grip bore;
a first securing device configured to prevent the tension cord from slipping out of the grip bore;
a second securing device configured to prevent the tension cord from slipping out of the grip bore, wherein the second securing device creates tension on the tension cord by restricting movement of the training device, and wherein the second securing device comprises a ball manufactured from wood that is larger in diameter than an opening that is created when a door is in an open position.

7. A golf swing training device comprising:
a grip including a grip bore;
a shaft including a shaft bore;
wherein said grip spans a substantial portion of the length of said shaft;
a tension cord received within the grip bore and the shaft bore;

a first securing device configured to prevent the tension cord from slipping out of the grip bore and the shaft bore;

a second securing device configured to prevent the tension cord from slipping out of the grip bore and the shaft bore, wherein the second securing device creates tension on the tension cord by restricting movement of the training device and is configured to be received within an opening formed in an open door, and wherein the second securing device comprises a ball that is larger in diameter than the opening.

8. The training device according to claim 7, wherein the ball is manufactured from wood.

* * * * *